US006155558A

United States Patent [19]

Maass

[11] Patent Number: 6,155,558

[45] **Date of Patent: *Dec. 5, 2000**

[54] FEEDING TABLE FOR SHEETS IN A FEEDER OF A SHEET-FED PRINTING PRESS

[75] Inventor: Burkhard Maass, Heidelberg, Germany

[73] Assignee: Heidelberger Druckmaschinen Aktiengesellschaft, Heidelberg, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/950,490

[22] Filed: Oct. 15, 1997

[30] Foreign Application Priority Data

Oct. 15, 1996 [DE] Germany ..... 296 17 889 U
May 26, 1997 [DE] Germany ..... 197 21 910

[51] Int. Cl.[7] ..... B65H 29/32

[52] U.S. Cl. ..... 271/194; 271/196; 271/197; 406/88

[58] Field of Search ..... 271/194, 195, 271/245, 246, 196, 197; 406/86, 88

[56] References Cited

U.S. PATENT DOCUMENTS

| | | | |
|---|---|---|---|
| 3,717,381 | 2/1973 | Hagler | 302/31 |
| 4,221,377 | 9/1980 | Bodewein et al. | 271/196 |
| 4,299,518 | 11/1981 | Whelan | 406/62 |
| 4,307,661 | 12/1981 | Wilkins et al. | 271/197 |
| 4,522,388 | 6/1985 | Heine et al. | 271/245 |
| 4,648,589 | 3/1987 | Emrich et al. | 271/195 |
| 4,776,577 | 10/1988 | Marschke et al. | 271/183 |
| 4,792,249 | 12/1988 | Lahr | 400/578 |
| 5,102,118 | 4/1992 | Vits | 406/88 |
| 5,133,273 | 7/1992 | Brocklehurst | 112/262.3 |
| 5,133,543 | 7/1992 | Eitel et al. | 271/197 |
| 5,139,253 | 8/1992 | Bohme et al. | 271/197 |
| 5,261,654 | 11/1993 | Kerber et al. | 271/183 |
| 5,348,285 | 9/1994 | Huser | 271/197 |
| 5,374,053 | 12/1994 | Doucet et al. | 271/245 |
| 5,411,251 | 5/1995 | Schmid et al. | 271/195 |
| 5,419,256 | 5/1995 | Pollich | 101/485 |
| 5,497,987 | 3/1996 | Henn et al. | 406/88 |
| 5,549,423 | 8/1996 | Lenhart | 406/86 |
| 5,624,111 | 4/1997 | Maass | 271/236 |
| 5,636,833 | 6/1997 | Maier et al. | 271/197 |
| 5,655,762 | 8/1997 | Yergenson | 271/221 |
| 5,699,736 | 12/1997 | Muller et al. | 101/232 |
| 5,718,176 | 2/1998 | Stephan | 406/88 |
| 5,761,998 | 6/1998 | Fricke et al. | 271/246 |
| 5,810,350 | 9/1998 | Pollich | 271/276 |
| 5,810,902 | 9/1998 | Brown et al. | 65/447 |
| 5,836,247 | 11/1998 | Stephen et al. | 101/420 |
| 5,941,520 | 8/1999 | Stephen et al. | 271/195 |
| 5,988,633 | 11/1999 | Henn et al. | 271/204 |
| 5,988,789 | 11/1999 | Nakahara | 347/32 |

FOREIGN PATENT DOCUMENTS

| | | | |
|---|---|---|---|
| 0305260A1 | 1/1989 | France | H01L 21/00 |
| 80 22 788 U1 | 2/1981 | Germany . | |
| 40 12 948 A1 | 10/1991 | Germany . | |
| 44 26 991 A1 | 2/1996 | Germany . | |
| 2255079 | 10/1992 | United Kingdom | B65H 5/22 |

*Primary Examiner*—Christopher P. Ellis
*Assistant Examiner*—Michael E. Butler
*Attorney, Agent, or Firm*—Herbert L. Lerner; Laurence A. Greenberg; Werner H. Stemer

[57] ABSTRACT

A feeder for a sheet-fed printing press includes a feeding table having a surface which, at least in subregions thereof, is formed with through openings, over which sheets separable or singlable by a suction head are transportable against lays for aligning the sheets and through which air feedable under the sheet in the region of the suction head is dischargeable in a downward direction, the feeding-table surface having edge portions formed with a respective inclination, the edge portions defining the openings.

9 Claims, 2 Drawing Sheets

2
1

FEEDING TABLE FOR SHEETS IN A FEEDER OF A SHEET-FED PRINTING PRESS

BACKGROUND OF THE INVENTION

FIELD OF THE INVENTION

The invention relates to a feeding table for sheets in a feeder of a sheet-fed printing press, the feeding table having a surface which, at least in subregions thereof, is formed with through openings, over which sheets separable or singlable by a suction head are transported against lays for aligning the sheets and through which air feedable under the sheet in the region of the suction head is dischargeable in a downward direction.

A feeding table of this general type corresponds to that of the state of the art generally practiced by various manufacturers of such feeders. When separating or singling the sheets supplied to the feeder from a sheet pile, large quantities of air are blown under the sheets. In particular, sheets formed of very light paper or other very light printing materials or stock tend to have wavy deformations and correspondingly lie in a wave-shaped manner on the feeding table. Unfavorable feeder register when aligning the sheets, or mackling phenomena can result therefrom.

As a countermeasure, excess air is removed in a downward direction through openings which are formed in the table plate, the openings having a cross section suitably matching the air quantity to be removed. The openings are holes or perforations conventionally of round, oval, and oblong shape as viewed in a top plan view. Corners or edges of the respective sheets can become caught in the holes or perforations during sheet transport, leading to grave consequences for the continuation of the printing operation.

SUMMARY OF THE INVENTION

It is accordingly an object of the invention, to provide a feeding table for sheets in a feeder of a sheet-fed printing press wherein sheets are prevented from catching by varying the openings in the table plate.

With the foregoing and other objects in view, there is provided, in accordance with the invention, a feeder for a sheet-fed printing press, comprising a feeding table having a surface which, at least in subregions thereof, is formed with through openings, over which sheets separable or singlable by a suction head are transportable against lays for aligning the sheets and through which air feedable under the sheet in the region of the suction head is dischargeable in a downward direction, the feeding-table surface having edge portions formed with a respective inclination, the edge portions defining the openings.

In accordance with another feature of the invention, there is provided at least one sheetmetal plate out of which the openings are punched, the inclinations being formed by metal deformation in the feeding-table surface portions defining the openings.

In accordance with a further feature of the invention, the inclination is formed in a downwardly stamped portion of the sheetmetal plate.

In accordance with an added feature of the invention, the sheets are transportable in a sheet transport plane over the feeding-table surface, and the inclination and the sheet transport plane enclose an acute angle.

In accordance with an additional feature of the invention, the enclosed angle is smaller than 45°.

In accordance with yet another feature of the invention, the openings, respectively, have a projected sublength, and the inclinations, respectively, have a projected maximum height or spacing from the feeding-table surface, the projected sublength of the openings, respectively, being less than the height of the inclinations, respectively.

In accordance with a concomitant feature of the invention, the inclinations, respectively, have a projected length which is a greater multiple of the thickness of the feeding-table plates, respectively.

Providing inclinations in the region of the openings prevents so-called "paper feed jams" at the edges of the openings. The openings are preferably formed by punched or stamped incisions and deformations adjoining them, which are stamped away from or downwardly out of the table plate. It is advantageous if each deformation has an inclination which, together with the sheet transport plane formed by the feeding-table surface, encloses an angle $\alpha$ smaller than 45°.

Other features which are considered as characteristic for the invention are set forth in the appended claims.

Although the invention is illustrated and described herein as embodied in a feeding table for sheets in a feeder of a sheet-fed printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
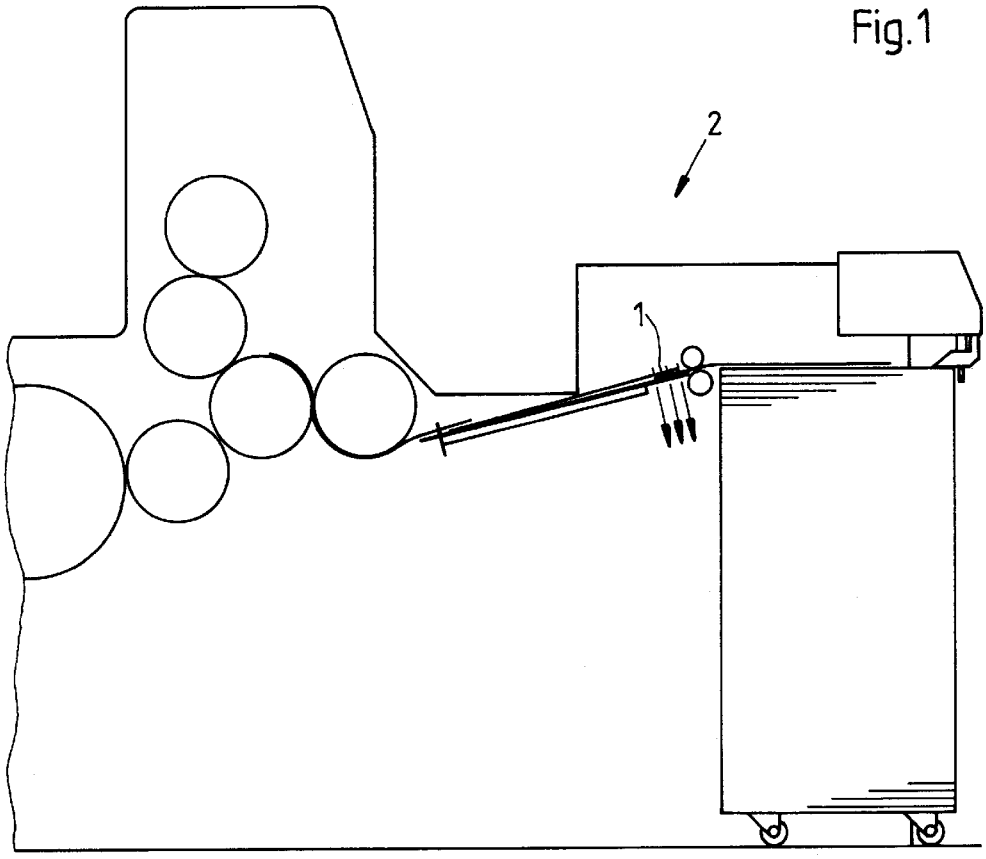
FIG. 1 is a diagrammatic side elevational view of a sheet feeder.
Figure 2:
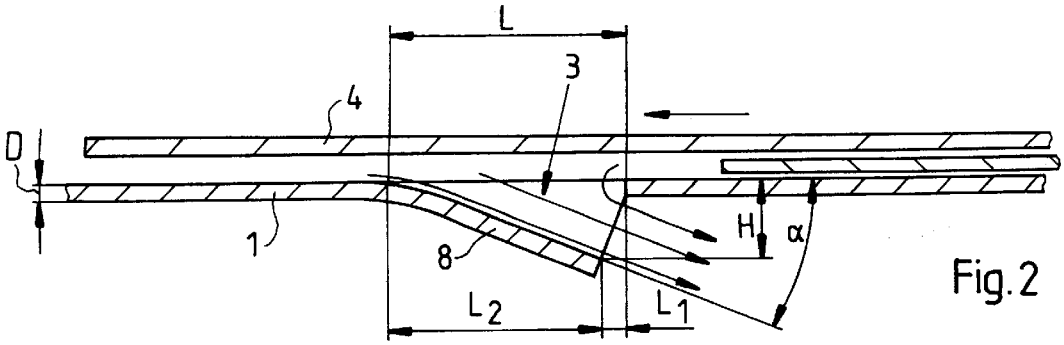
FIG. 2 is a longitudinal sectional view, parallel to sheet transport, of a table plate forming a feeding table of the sheet feeder.
Figure 3:
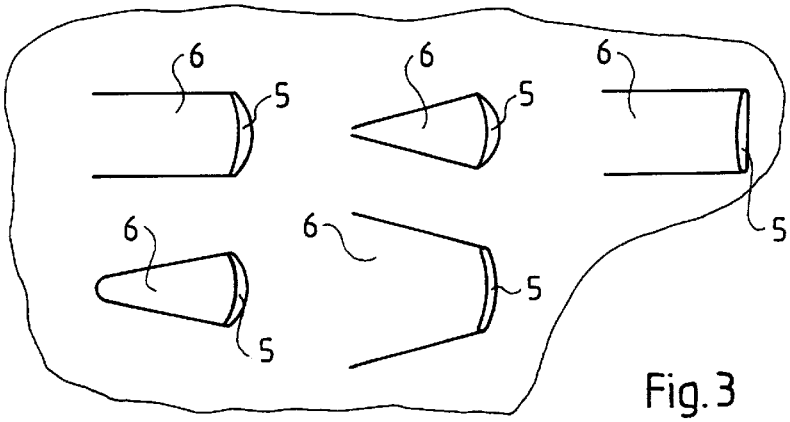
FIG. 3 is a fragmentary top plan view of the table plate according to FIG. 2 formed with a plurality of different openings therein.

Referring now to the drawings and, first, particularly to FIGS. 1 and 2 thereof, there is shown therein a feeding table plate 1 of a feeder 2 having several openings 3 of length L formed therein, through which air blown under the sheet 4 during sheet separation or singling can flow out or discharge in a downward direction, as represented by the associated arrows. In the case of the exemplary embodiment according to FIG. 2, as represented in the plan view of FIG. 3, the openings 3 are formed of round or arcuate incisions 5 running approximately crosswise or transversely to the sheet feeding direction represented by the horizontal arrow shown near the top of FIG. 2. A respective deformed portion 6 stamped downwardly out of the table plate 1, as viewed in FIG. 2, follows each of the incisions 5 in the sheet travel direction. Different geometries of these deformed portions 6 are represented in FIG. 3. Accordingly, each opening 3 with the respective deformed portion 6 can constitute an air guiding body having sides converging or diverging towards or extending parallel to the respective incision 5.

Figure 4:
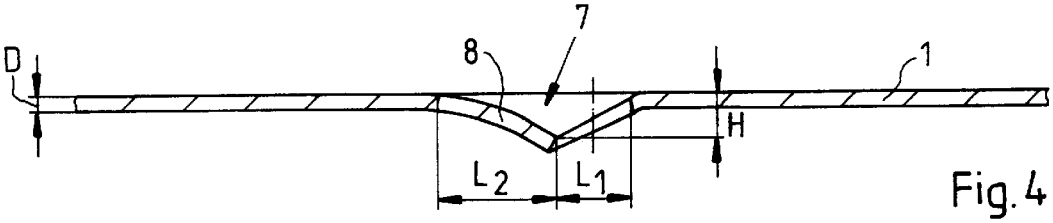
FIG. 4 is a view like that of FIG. 2 of a different exemplary embodiment of the table plate.
Figure 5:
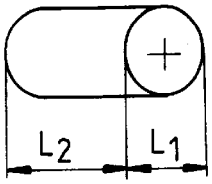
FIG. 5 is a fragmentary top plan view of FIG. 4 showing the opening formed in the table plate.

In the exemplary embodiment shown in FIGS. 4 and 5, the opening 3 is funnel-shaped so that a funnel-shaped punched indentation 7, which is inclined with respect to the normals to the table surface in the sheet transport direction, is effectively used for solving the aforementioned problem.

The table plate 1 may be formed of sheet steel, sheetmetal or other metallic material and, if necessary or desirable, may also be formed of plastic material.

The deformed portions 6 and the respective stamped or punched indentation 7 have an inclination 8 which, with the sheet transport plane formed by the surface of the table plate 1, enclose an angle $\alpha$ smaller than 45°. The length L of the opening 3 is subdivided into a partial or sublength $L_1$ of the opening 3 projected onto the surface of the table plate 1 in the region of the continuous opening and a partial or sublength $L_2$ in the region of the inclinations 8. The sublength $L_1$ in this case is smaller than a height H between the inclinations 8 and the table plate 1. Due to these features, the sheet 4 to be transported is prevented from becoming engageable by the edges or corners thereof under the free edge of the inclination 8. The inclination thus offers assurance that the sheet edges or corners cannot engage under the defining margin of an opening so that the sheet is prevented from sticking in the region of the openings. The sublength $L_2$ of the inclination 8, in the foregoing regard, is a larger multiple or much greater than a thickness D of the table plate 1.

I claim:

1. A feeder table assembly for a sheet-fed printing press, comprising:

a feeding table having a surface for transporting sheets in a transport direction thereover, said surface formed with a plurality of openings therein, each one of said plurality of openings defining an inclined edge portion depending from said surface in a direction opposite the transport direction;

said plurality of openings formed in a region of a suction head for allowing air blown under the sheets to discharge below said feeding table.

2. The feeding table according to claim 1, comprising at least one sheetmetal plate, each said inclined edge portion being formed by a deformation in said surface.

3. The feeding table according to claim 2, wherein said deformation is formed in a downwardly stamped portion of said sheetmetal plate.

4. The feeding table according to claim 2, wherein said sheetmetal plate has a thickness, and each said inclined edge portion has a projected length that is greater than the thickness of the sheetmetal plate.

5. The feeding table according to claim 1, wherein the sheets are transportable in a sheet transport plane over said surface of said feeding table, and at least one inclined edge portion and said sheet transport plane enclose an acute angle.

6. The feeding table according to claim 5, wherein said acute angle is smaller than 45°.

7. The feeding table according to claim 1, wherein each said inclined edge portion has a projected sublength and has a projected maximum height or spacing from said surface, said projected sublength of each said inclined edge portion being less than said projected maximum height.

8. The feeder according to claim 1, wherein each said inclined edge portion defines an acute angle with respect to said surface.

9. The feeder according to claim 8, wherein said acute angle is less than 45°.

* * * * *